US005509578A

United States Patent [19]

Livingstone

[11] Patent Number: 5,509,578

[45] Date of Patent: Apr. 23, 1996

[54] DISPENSING PUMP

[75] Inventor: William Livingstone, Peterborough, United Kingdom

[73] Assignee: Bespak plc, Norfolk, United Kingdom

[21] Appl. No.: 410,519

[22] Filed: Mar. 27, 1995

[30] Foreign Application Priority Data

Apr. 26, 1994 [GB] United Kingdom ..... 9408276

[51] Int. Cl.[6] ..... B67D 5/00

[52] U.S. Cl. ..... 222/82; 222/83; 222/321.6

[58] Field of Search ..... 222/82, 83, 162, 222/183, 321.2, 321.6, 321.9, 320, 323, 324, 325, 382, 383, 373; 128/203.12

[56] References Cited

U.S. PATENT DOCUMENTS

| | | | |
|---|---|---|---|
| 4,265,372 | 5/1981 | Wainberg | 222/82 |
| 5,328,055 | 6/1994 | Battle | 222/325 |
| 5,341,993 | 8/1994 | Haber et al. | 222/321.6 |
| 5,433,343 | 7/1995 | Meshbers | 222/162 |

FOREIGN PATENT DOCUMENTS

| | | |
|---|---|---|
| 065432 | 11/1982 | European Pat. Off. . |
| 236152 | 9/1987 | European Pat. Off. . |
| 0336415 | 10/1989 | European Pat. Off. . |
| 546607 | 6/1993 | European Pat. Off. . |
| 1409845 | 10/1975 | United Kingdom . |
| 1464773 | 2/1977 | United Kingdom . |
| 2014233 | 8/1979 | United Kingdom . |

*Primary Examiner*—Andres Kashnikow
*Assistant Examiner*—Philippe Derakshani
*Attorney, Agent, or Firm*—Beveridge, DeGrandi, Weilacher & Young

[57] ABSTRACT

A pump (1) has a tubular inlet portion (4) which is arranged to penetrate the mouth (27) of a container having a seal (29) in order to dispense liquid from the container. The pump has a body (2) connected to a housing (23) comprising holding means (25) which holds the container such that in a first position the inlet portion of the pump is external to the seal and in a second position the inlet portion extends through the seal into a reservoir (30) to allow liquid to be dispensed. In the second position, the inlet portion projects into the reservoir to an extent sufficient to displace a volume of liquid filling the inlet channel (6) of the pump and occupying the pump chamber (3). The pump is thereby rendered self priming by the initial movement between the first and second positions which at the same time disrupts the seal. The pump is particularly useful for the nasal administration of liquid sprays from an ampule having an elastomeric seal closure or a duck bill valve.

15 Claims, 7 Drawing Sheets

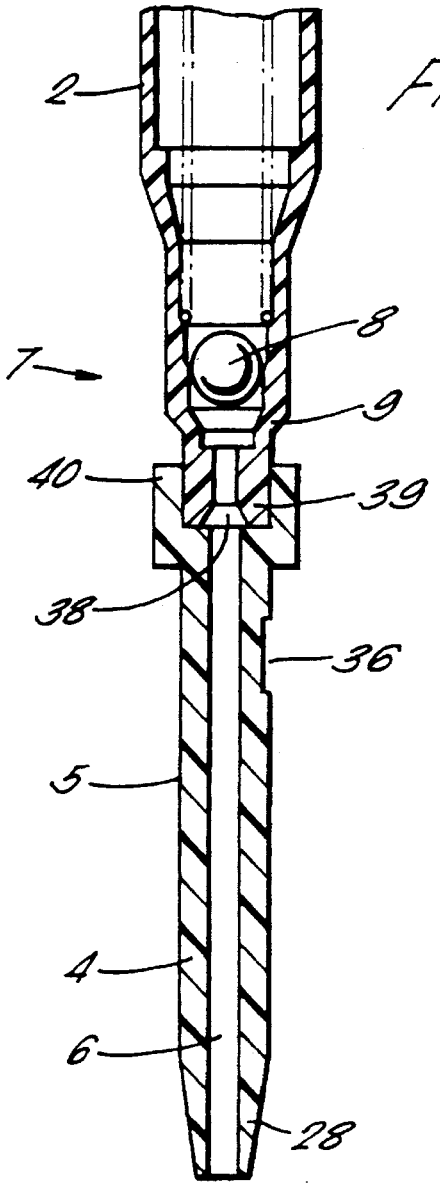
FIG. 7.
FIG. 8.
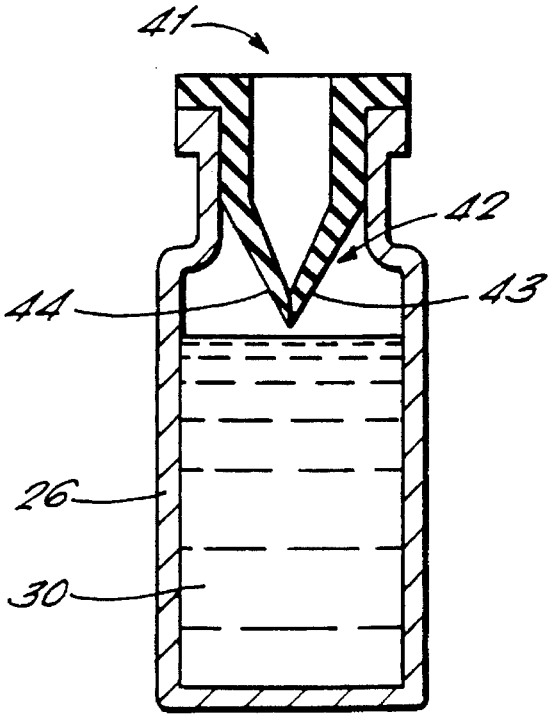

DISPENSING PUMP

This invention relates to a dispensing pump primarily but not exclusively for the nasal administration of a liquid spray from a container in the form of an ampule with an elastomeric seal closure.

It is known to provide pumps, typically fitted with spray nozzles adapted for nasal or opthalmic use, in which the pump is fitted to a container and the container filled with a quantity of liquid to be subsequently dispensed. In order to maintain the integrity of the liquid during storage, it is necessary to provide some means of sealing the enclosed volume of liquid against the ingress of contaminants including moisture and bacteria and also against evaporative loss. For certain liquid substances, prolonged contact with air cannot be tolerated.

It is an object of the present invention to provide a pump suitable for dispensing liquid from a container wnich is sealed until immediately prior to use of the pump and which allows the liquid to be conveniently adminstered with minimal wastage. This is a particular requirement where a small volume of liquid drug having a high value is to be dispensed.

It is a further object of the present invention to provide a pump which can be made ready for use immediately after the seal of the container is first opened.

According to the present invention there is disclosed a pump for use in dispensing liquid from a container defining a reservoir which is accessible via a container mouth closed by a disruptable seal, the pump comprising a body defining a chamber, a tubular inlet portion defining an inlet channel communicating with the chamber, an actuating stem defining a dispensing channel through which liquid is dispensed from the chamber in use, and a housing being connected to the body and comprising holding means operable to hold the container in use such that in a first position of the container relative to the body the inlet portion is external to the disruptable seal and in a second position of the container relative to the body the inlet portion extends through the seal into the reservoir whereby the inlet channel communicates with the reservoir, characterised in that the inlet portion projects into the reservoir in the second position of the container relative to the body to an extent sufficient to displace a volume of liquid sufficient to fill the inlet channel and to occupy the pump chamber.

Air may thereby be fully purged from the pump chamber ready for use so that the pump may be regarded as self priming.

A further advantage of such a pump is that the container may remain sealed until immediately prior to the first use of the pump at which time the seal is penetrated by the inlet portion.

Preferably the housing defines a cylindrical recess and the holding means comprises a tubular holder slidably received in the recess.

Advantageously the holding means further comprises co-operating catch formations of the holder and the housing respectively, the catch formations being operable to retain the holder in respective first and second positions relative to the housing corresponding to the first and second positions of the container relative to the body and being releasable to facilitate movement of the holder between the first and second positions.

The container may thereby be packaged with the pump such that during storage the container remains sealed and the container is held in its first position relative to the body ready for first use of the pump.

Preferably the inlet portion comprises a tubular extension of the body of the body and defines a cylindrical surface which is sealingly engageable in use by the seal during penetrating movement by the inlet portion, the surface being co-operable with the seal to maintain closure of the container mouth.

An advantage of this arrangement is that maintaining an airtight closure at the mouth of the container during penetration allows liquid to be displaced by penetration of the inlet portion into the container such that liquid is forced into the pump via the inlet channel. The pump chamber, in its configuration of minimum volume, may thereby be filled with liquid and purged of air by the inflow of liquid. Subsequent expansion of the pump chamber to its maximum volume will then draw liquid into the chamber to fully prime the pump ready for first actuation.

Conveniently the tubular extension comprises an indentation in the cylindrical surface at a location such that in the second position of the container relative to the body the indentation defines a by-pass channel in registration with the seal to facilitate the ingress of air to the reservoir.

The by-pass channel thereby enables the pressure within the container to be maintained at ambient pressure when liquid is pumped from the container.

Advantageously the pump further comprises an actuator connected to the actuating stem and defining a dispensing outlet and at least one gripping formation facilitating manual displacement of the actuator relative to the holding means whereby, in use, the actuator and holding means are relatively displaceable to effect depression of the actuating stem relative to the body thereby actuating the pump and providing relative movement of the container and the body between the first and second positions.

Preferably the pump comprises a first spring means operable between the actuating stem and the body whereby the actuating stem is normally biassed into an extended position and is movable against spring bias into an actuated position, the first spring means providing a first spring force which is less than a dislocation force required to dislocate the holding means from the first position such that movement of the actuator relative to the holding means effects movement of the container from the first position into the second position only after the stem is depressed into the actuated position.

Such an arrangement ensures that the piston is moved into a position in which the volume of the chamber is minimised prior to introducing liquid into the chamber, thereby assisting in the priming of the pump by exhausting air from the chamber.

Preferably the pump comprises outlet valve means operable to release fluid from the chamber into the dispensing channel in response to the fluid pressure exceeding a threshold value during displacement of the actuating stem between the extended position and the actuated position and valve opening means operable to hold open the outlet valve means when the stem reaches the actuated position.

Such outlet valve means has the advantage of being self-opening when the stem is fully depressed thereby ensuring that, when liquid is subsequently forced into the chamber from the container, air is able to escape from the chamber through the outlet valve means and this ensures that the chamber is filled with liquid.

Preferably the pump comprises a piston movable in the chamber in response to movement of the actuating stem to vary the chamber volume, the piston being slidably mounted on the stem and biassed by action of a second spring means into a seated position in which the piston closes a passageway communicating between the chamber and the dispensing channel, the piston being displaceable relative to the stem against the spring force of the second spring means in response to excess fluid pressure within the chamber into an unseated position in which the passageway is opened to thereby constitute the outlet valve means.

Such an arrangement ensures that liquid is dispensed via the actuator nozzle at a sufficient pressure to ensure atomisation since the outlet valve will only open when a sufficient fluid pressure is present.

Preferably the body defines a stop formation internally of the chamber at a location such that the stop formation is engageable with the piston in the actuated position of the stem so as to move the piston into the unseated position and thereby constituting the valve opening means.

The inlet portion may be formed integrally with the body or alternatively may be formed separately from the body and may then be constituted by a dip tube coupled to the body.

Dispensing apparatus in accordance with the present invention may comprise a pump as disclosed above in combination with a container which preferably is constituted by an ampule having an elastomeric seal.

Preferred embodiments of the present invention will now be disclosed by way of example only and with reference to the accompanying drawings of which:

FIG. 7 is a sectioned elevation showing a modification to the pump of preceding Figures in which a dip tube is coupled externally onto the pump body; and FIG. 8 is a sectioned elevation of an alternative container for use with the pump of any of the preceding Figures, the container comprising a duck bill valve seal.

Figure 1:
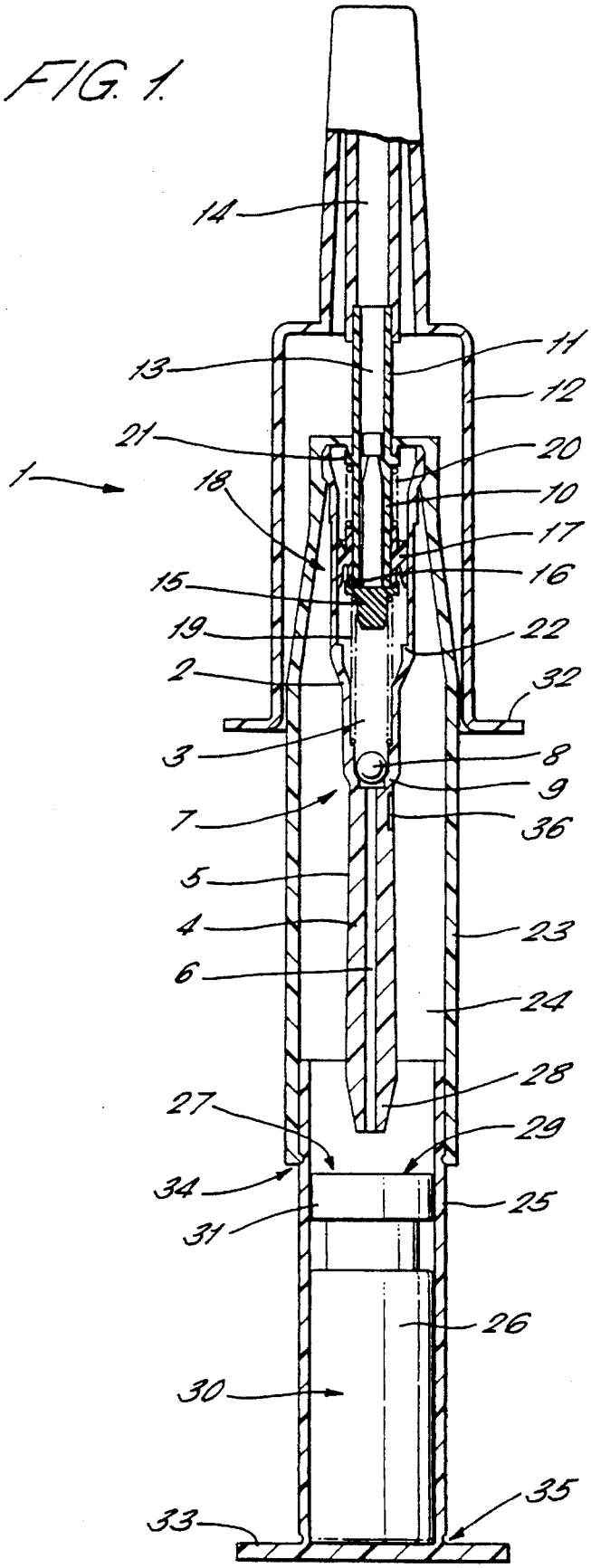
FIG. 1 is a sectioned elevation of a pump with a container fitted to a housing of the pump in readiness for use.

In FIG. 1 a pump 1 comprises a body 2 defining a cylindrical chamber 3 and having an inlet portion 4 with an elongate external cylindrical surface 5. The inlet portion 4 defines an inlet channel 6 communicating with the chamber 3 via an inlet valve 7 comprising a spherical valve member 8 co-operating with an annular valve seat 9, the inlet valve being arranged to allow the flow of liquid into the chamber and to close the inlet channel in response to excess fluid pressure within the chamber.

An actuating stem 10 extends co-axially within the chamber 3 and projects from the body 2 so as to be externally accessible, an end portion 11 of the stem being connected to an actuator 12.

The stem 10 defines a dispensing channel 13 for the discharge of liquid from the chamber 3, the dispensing channel communicating with an outlet duct 14 defined by the actuator. The actuator 12 further defines a spray nozzle (not shown) communicating with the outlet duct 14 and is shaped so as to be suitable for nasal insertion.

An innermost end portion 15 of the stem 10 closes the dispensing channel 13 and a radially extending passageway 16 adjacent to the innermost end portion provides communication with the chamber 3. An annular piston 17 is slidably received externally on the stem 10 and normally overlays the passageway 16 so as to constitute an outlet valve means 18.

The stem 10 is biassed into an extended position by a first spring 19 and a second spring 20 acts between an annular projection 21 of the stem and the piston 17 so as to normally bias the piston towards the innermost end portion 15.

Figure 2:
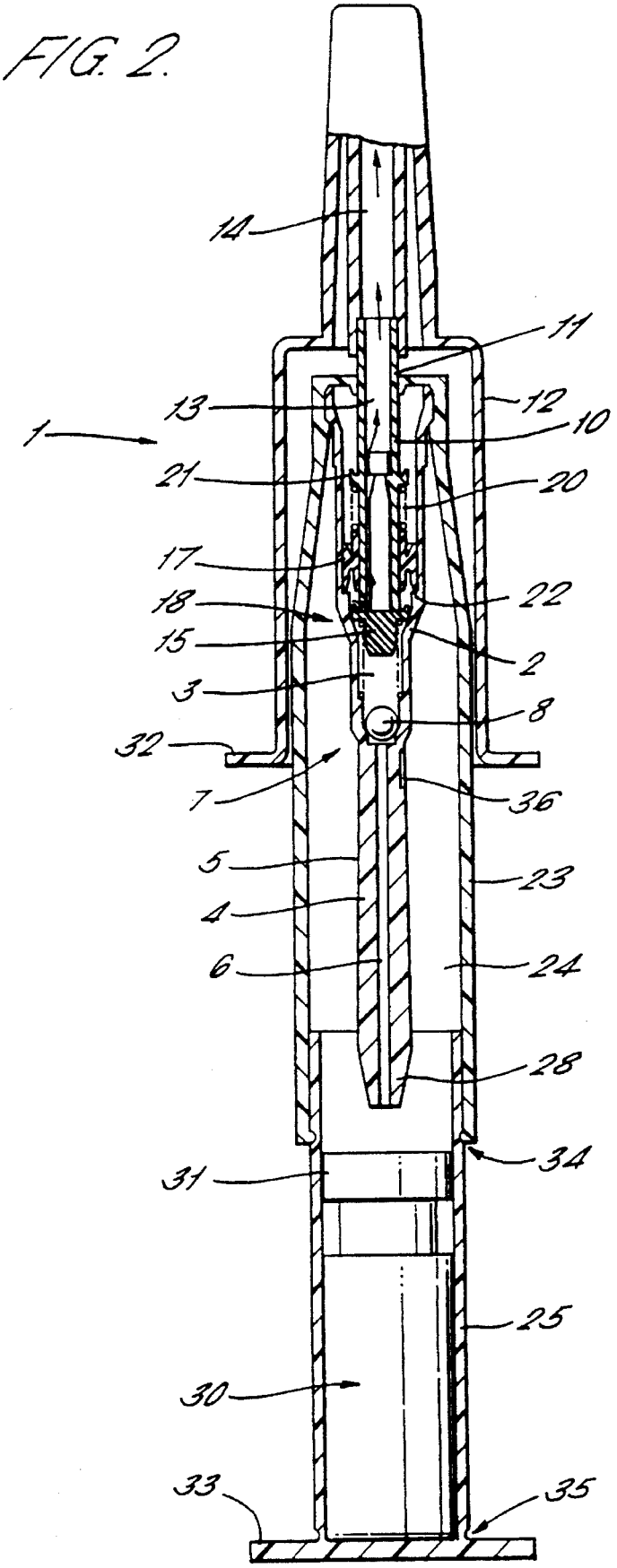
FIG. 2 is a sectioned elevation of the pump of FIG. 1 following a first stage of movement in which the actuator stem is moved into its fully actuated position.

A stop formation 22 in the form of a radially inwardly projecting flange is formed in the body adjacent to the inward limit of travel of the innermost end portion 15 and is arranged such that, immediately before the stem reaches its fully actuated position, the piston 17 encounters the stop formation 22 thereby being arrested. Continued travel of the stem into the fully actuated position exposes the passageway 16 and thereby opens the outlet valve means 18 as shown in FIG. 2.

Figure 4:
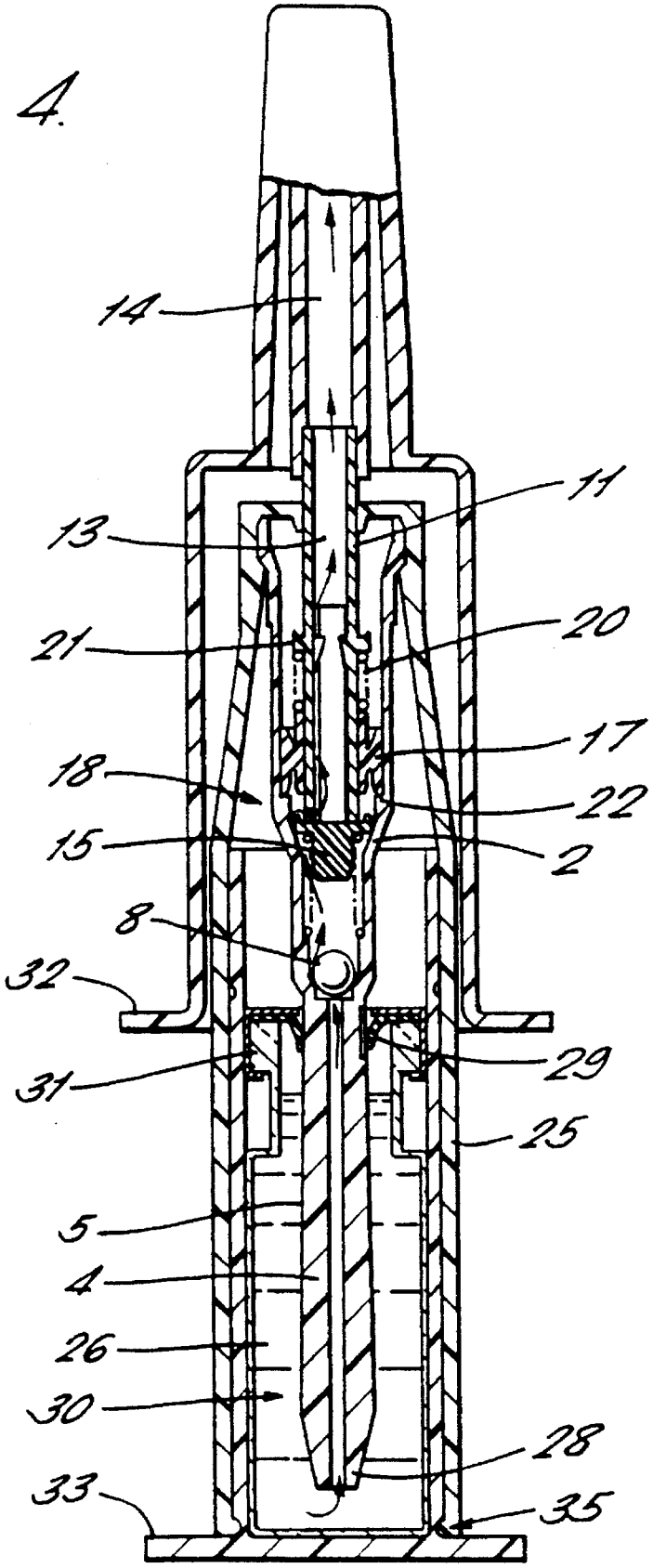
FIG. 4 is a sectioned elevation of the pump of preceding Figures showing the actuator fully depressed to a position in which the inlet portion extends fully into the container.
Figure 5:
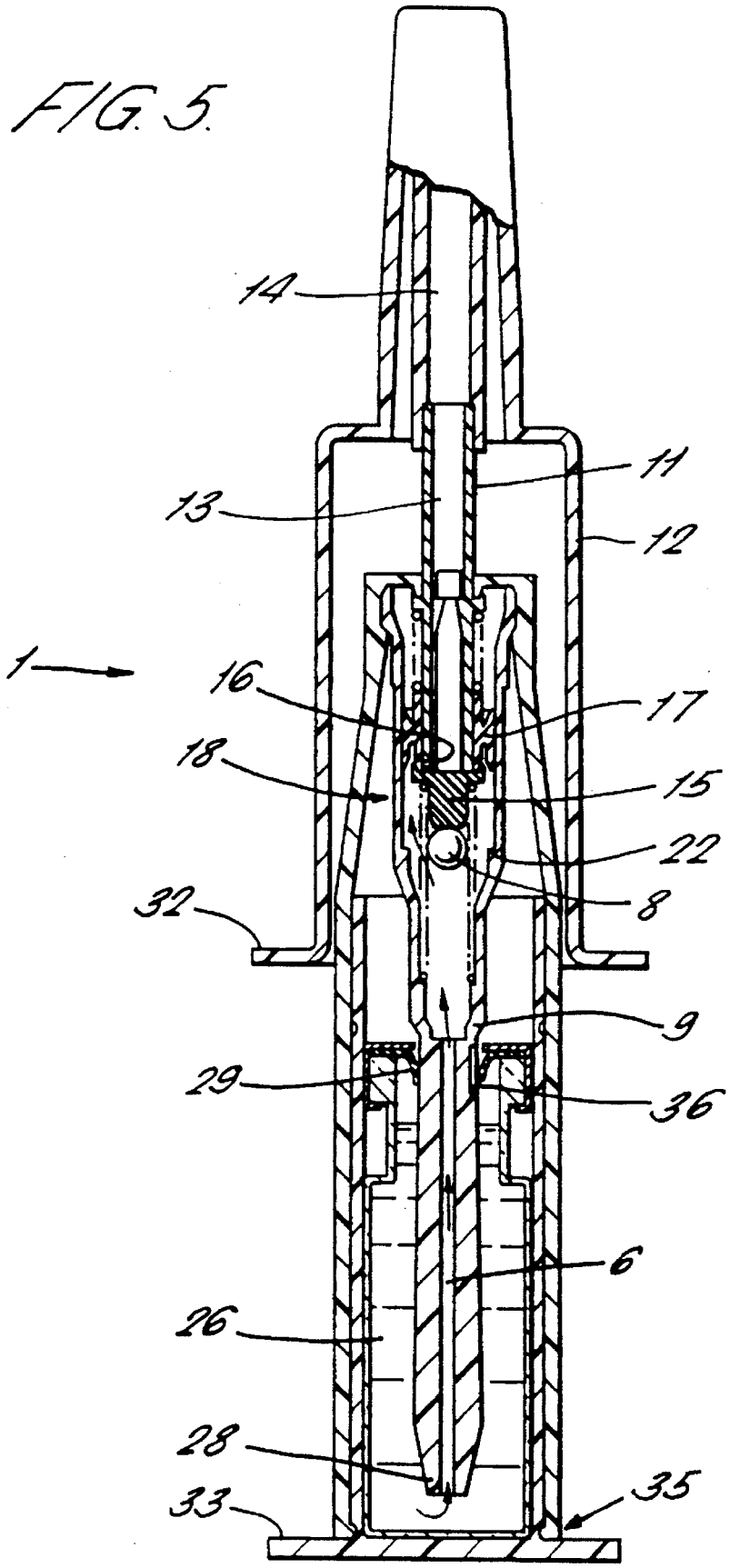
FIG. 5 is a sectioned elevation of the pump of preceding Figures showing the subsequent stage of the actuator having relaxed to a rest position in which the pump chamber is primed ready for use.

A generally cylindrical housing 23 is connected externally to the body 2 and extends co-axially with the inlet portion 4 to define a cylindrical socket 24 within which the inlet portion extends. A tubular holder 25 is received in the socket 24 so as to be telescopically movable relative to the housing 23 between a first position as shown in FIGS. 1 and 2 and a second position as shown in FIG. 4 and 5.

A container 26 in the form of a glass ampule is located within the holder 25 so as to be held in a position in which a mouth 27 of the container is presented to a pointed leading end 28 of the inlet portion 4. The container 26 has an elastomeric seal 29 in the form of a disruptable diaphragm normally closing the mouth 27. The container 26 defines a reservoir 30 for a sterile liquid drug to be nasally adminstered.

The seal 29 is supported by a metal ferrule 31 which has a central aperture slightly larger than the external diameter of the cylindrical surface 5.

The actuator 12 is provided with gripping formations 32 projecting radially outwardly of the pump 1, the formations being suitable for gripping by two fingers of a user, the holder 25 having a handle portion 33 adapted to be depressed by the user's thumb when the fingers engage the gripping formations such that a squeezing action conveniently impells the actuator and the holder 25 towards one another.

During such actuating movement, the holder 25 initially remains stationary relative to the housing 23 by virtue of snap-fit catch formations 34, an initial stage of movement thereby being provided in which the actuating stem 10 is depressed relative to the body 2. The volume of the chamber 3 is reduced during this initial stage of movement by action of the piston 17. Air within the chamber 3 is compressed and released at the limit of travel of the actuating stem when the outlet valve means 18 is opened by engagement between the piston 17 and the stop formations 22.

Continued movement of the actuator towards the holder 25 disengages the snap-fit catch formations 34 so that the holder 25 and the body 2 move towards one another. The leading end 28 of the inlet portion 4 then moves into contact with the seal 29 and is progressively urged through the seal into the reservoir 30. During the passage of the inlet portion 4 through the seal 29, the seal makes sealing contact with the cylindrical surface 5 thereby resulting in the liquid within the reservoir 30 becoming pressurised since the available volume within the reservoir 30 is progressively decreased by displacement as the inlet portion 4 progressively moves within it. Pressurised liquid enters the inlet channel 6 and passes through the inlet valve 7 into the chamber 3, in doing so displacing air from the inlet channel 6 and the chamber and resulting in this air being expelled through the dispensing channel 13.

Relative movement between the actuator 12 and the holder 25 is arrested by engagement of further snap-fit catch formations 35 which thereafter maintain the container 26 in its second position relative to the body 2.

The inlet portion 4 is recessed to provide an air vent 36 which by-passes the seal 29 only when the inlet portion is fully inserted into the container as shown in FIGS. 4 and 5. This air vent prevents the creation of a vacuum within the container as liquid is dispensed.

In this position the pump 1 is primed by the presence of liquid within the chamber 3. The actuator is then released and returns to its rest position by action of the first spring 19 which moves the stem 10 into its extended position. During this travel the piston 17 is returned to its normal rest position in abuttment with the innermost end portion 15 of the stem in which the passageway 16 is closed. The volume of the chamber 3 is increased during this travel and, since the outlet valve means 18 is closed, liquid is drawn through the inlet valve 7 from the reservoir 30 via the inlet channel 6.

The pump 1 is now fully primed and ready for use. The actuator 12 is presented to the user's nasal cavity and the user then applies manual pressure between the gripping formations 32 and the handle portion 33. By this action, the actuator 12 remains in a fixed position and the body 2 is driven upwardly so as to achieve relative movement of the stem 10 within the chamber 3. The volume of the chamber 3 is reduced and, because liquid is substantially incompressible, a rapid rise in fluid pressure within the chamber is achieved thereby forcing open the outlet valve means 18 by displacing the piston 17 against the spring force of the second spring 20.

On complexion of the actuating stroke, release of the actuator 12 allows the stem and piston to return to their rest positions under action of the first spring 19 thereby recharging the chamber with liquid and the pump is again ready for use. Typically a sufficient volume of liquid is provided within the reservoir 30 for four successive actuating strokes to deliver a spray of liquid.

The sequence of operation illustrated with reference to FIGS. 1 to 5 is as follows. In FIG. 1, the pump 1 and container 26 are in a storage configuration in which the seal 29 remains intact and the container is securely held in spaced apart relationship relative to the inlet portion 4 of the pump.

In FIG. 2, an initial movement of the actuator 12 vents air from the pump chamber 3 and fully depresses the stem 10 while at the same time engaging the piston 17 against the stop formation 22 so that the outlet valve means 18 is held open.

Figure 3:
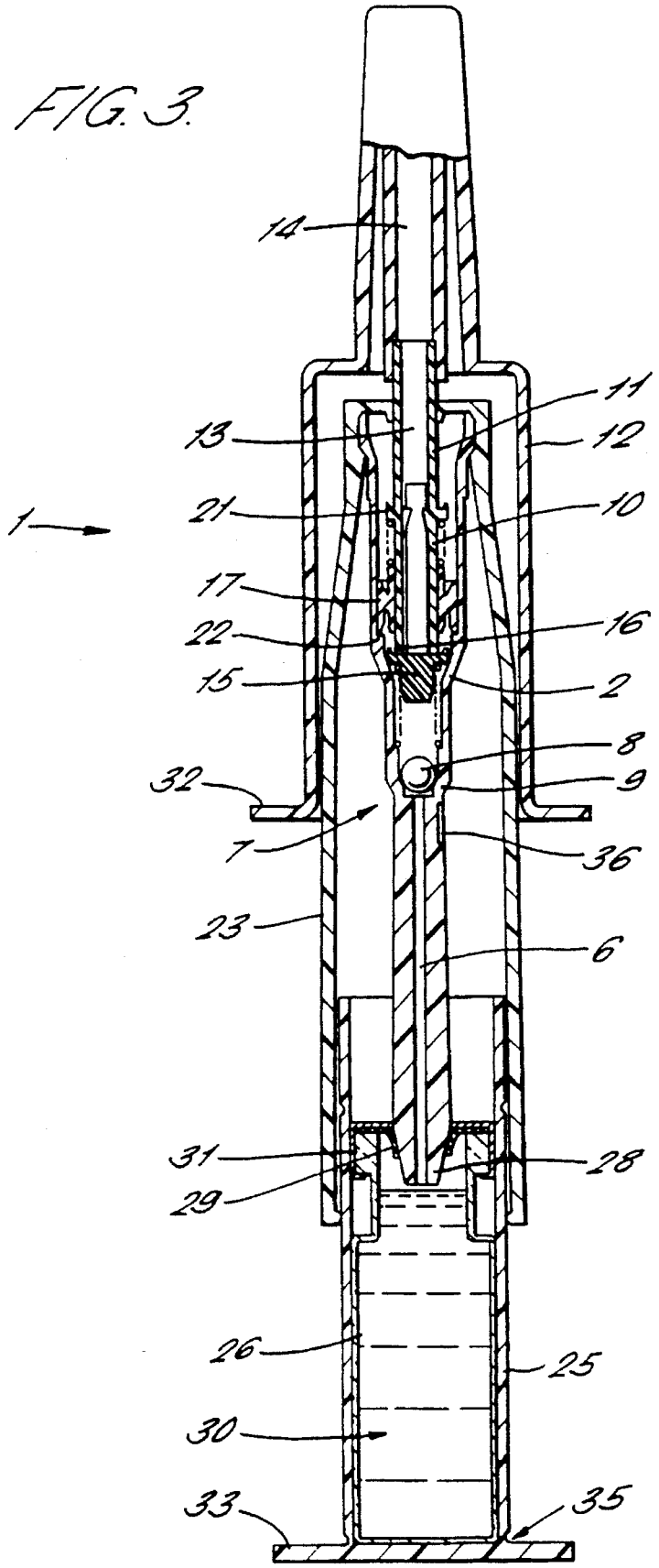
FIG. 3 is a sectioned elevation of the pump of preceding Figures showing penetration of the seal by the inlet portion.

In FIG. 3, continued movement of the actuator 12 is shown intermediate the first and second positions of the container 26 relative to the pump body 2, the inlet portion 4 being shown penetrating the elastomeric seal 29.

In FIG. 4 the actuator 10 is fully depressed such that the inlet portion 4 extends to its maximum extent into the container 26 and has displaced liquid through the inlet channel 6 into the pump chamber 3. This inflow of liquid expels air through the outlet valve means 18 so as to be vented via the dispensing channel 13.

FIG. 5 shows the position of the actuator 12 following relaxation of manual squeezing action between the gripping formations 32 and the handle portion 33, the actuator stem 10 having been returned by spring action to its extended position and further liquid having been drawn into the chamber 3 by associated retraction of the piston 17 so that the pump chamber is now fully primed with liquid.

FIG. 5 therefore shows the pump 1 ready for use. During subsequent use the container 26 remains in its second position as shown in FIGS. 4 and 5. Depression and release of the actuator 12 at each actuating stroke of the pump 1 results in liquid being displaced from the chamber 3 and released by operation of the outlet valve means 18, the chamber be replenished with liquid during the return stroke of the actuator via the inlet valve 7.

Figure 6:
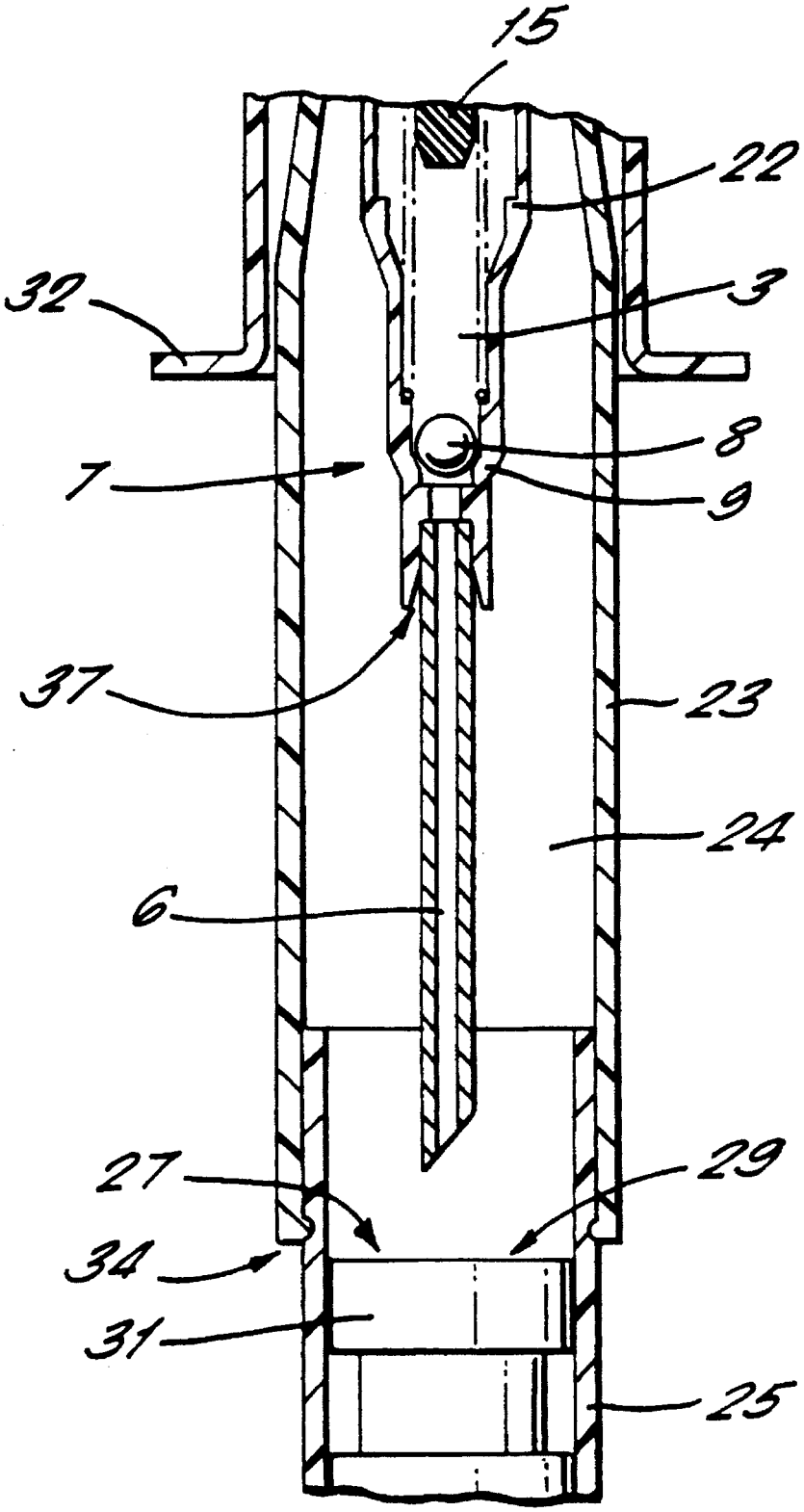
FIG. 6 is a sectioned elevation of an alternative pump having a dip tube.

An alternative pump is illustrated in FIG. 6 where corresponding reference numerals are used for corresponding elements where appropriate.

The pump of FIG. 6 incorporates an inlet portion 4 which is formed separately from the body 2 and which is received as a push-fit within a cylindrical recess 37 in the manner of a conventional dip tube.

The arrangement of FIG. 6 has the advantage that a conventional displacement pump as shown may be utilised by the addition of a suitable housing 23 and actuator 12, the inlet portion or dip tube 4 being selected to be substantially rigid and having a pointed leading end to assist in penetration of the seal 29.

An alternative arrangement is illustrated in FIG. 7 and will now be described using corresponding reference numerals to those of preceding Figures where appropriate for corresponding elements. In FIG. 7, a pump body 2 has an inlet 38 defined in an end portion 39 which houses the inlet valve 7.

An inlet portion 4 is formed separately from the body 2 and defines an inlet channel 6 extending between a leading end 28 and a connector portion 40 which is received externally as a sliding fit onto the end portion 39.

The inlet channel 6 thereby communicates with the inlet 38 and conducts liquid from the reservoir 30 to the pump chamber 3 in the same manner as described above with reference to FIG. 1.

The external diameter of the inlet portion 4 is selected to be sufficient to displace the volume of liquid from the reservoir required to effect self priming of the pump by filling the inlet channel 6 and pump chamber 3.

The embodiments of the pump disclosed above may alternatively be used in conjunction with a container of the type shown in FIG. 8 and described using corresponding reference numerals to those of preceding Figures where appropriate for corresponding elements.

In FIG. 8 a container 26 defines a reservoir 30 receiving liquid to be dispensed and having a mouth 41 sealed by means of a duck bill valve 42. the duck bill valve 42 is arranged to project inwardly of the mouth 41 such that elastomeric lips 43 and 44 of the valve are normally resiliently biassed together in a sealed configuration. During insertion of the leading end 28 of the inlet portion 4 in use, the lips 43 and 44 are pushed apart and retained in sliding sealing relationship with the cylindrical surface 5.

The container 26 may also be provided with a foil seal (not shown) overlaying the mouth 41 during storage and which is removable immediately prior to use.

The actuator 12 disclosed with reference to the above embodiments may be modified for alternative uses of the pump, such uses may for example include opthalmic use.

I claim:

1. A pump for use in dispensing liquid from a container defining a reservoir which is accessible via a container mouth closed by a seal, the pump comprising a body defining a chamber, a tubular inlet portion defining an inlet channel communicating with the chamber, an actuating stem defining a dispensing channel through which liquid is dispensed from the chamber in use, and a housing being connected to the body and comprising holding means operable to hold the container in use such that in a first position of the container relative to the body the inlet portion is external to the seal and in a second position of the container relative to the body the inlet portion extends through the seal into the reservoir whereby the inlet channel communicates with the reservoir, wherein the inlet portion projects into the reservoir in the second position of the container relative to the body to an extent sufficient to displace a volume of liquid sufficient to fill the inlet chamber and to occupy the pump channel.

2. A pump as claimed in claim 1 wherein the housing defines a cylindrical recess and the holding means comprises a tubular holder slidably received in the recess.

3. A pump as claimed in claim 2 wherein the holding means further comprises co-operating catch formations of the holder and the housing respectively, the catch formations being operable to retain the holder in respective first and second positions relative to the housing corresponding to the first and second positions of the container relative to the body and being releasable to facilitate movement of the holder between the first and second positions.

4. A pump as claimed in claim 1 wherein the inlet portion comprises a tubular extension of the body defining a cylindrical surface which is sealingly engageable in use by the seal during penetrating movement by the inlet portion, the surface being co-operable with the seal to maintain closure of the container mouth.

5. A pump as claimed in claim 4 wherein the tubular extension comprises an indentation in the cylindrical surface at a location such that in the second position of the container relative to the body the indentation defines a by-pass channel in registration with the seal to facilitate the ingress of air to the reservoir.

6. A pump as claimed in claim 1 comprising an actuator connected to the actuating stem and defining a dispensing outlet and at least one gripping formation facilitating manual displacement of the actuator relative to the holding means whereby, in use, the actuator and holding means are relatively displaceable to effect depression of the actuating stem relative to the body thereby actuating the pump and providing relative movement of the container and the body between the first and second positions.

7. A pump as claimed in claim 6 comprising first spring means operable between the actuating stem and the body whereby the actuating stem is normally biassed into an extended position and is movable against spring bias into an actuated position, the first spring means providing a first spring force which is less than a dislocation force required to dislocate the holding means from the first position such that movement of the actuator relative to the holding means effects movement of the container from the first position into the second position only after the stem is depressed into the actuated position.

8. A pump as claimed in claim 1 comprising outlet valve means operable to release fluid from the chamber into the dispensing channel in response to the fluid pressure exceeding a threshold value during displacement of the actuating stem between the extended position and the actuated position and valve opening means operable to hold open the outlet valve means when the stem reaches the actuated position.

9. A pump as claimed in claim 8 comprising a piston movable in the chamber in response to movement of the actuating stem to vary the chamber volume, the piston being slidably on the stem and biassed by action of a second spring means into a seated position in which the piston closes a passageway communicating between the chamber and the dispensing channel, the piston being displaceable relative to the stem against the spring force of the second spring means in response to excess fluid pressure within the chamber into an unseated position in which the passageway is opened to thereby constitute the outlet valve means.

10. A pump as claimed in claim 9 wherein the body defines a stop formation internally of the chamber at a location such that the stop formation is engageable with the piston in the actuated position of the stem so as to move the piston into the unseated position and thereby constituting the valve opening means.

11. A pump as claimed in claim 1 wherein the inlet portion is formed integrally with the body.

12. A pump as claimed in claim 1 wherein the inlet portion is formed separately from the body and is constituted by a dip tube coupled to the body.

13. Dispensing apparatus comprising a pump as claimed in claim 1 in combination with a container as defined in claim 1.

14. Dispensing apparatus as claimed in claim 13 wherein the container is an ampule having a seal constituted by a disruptable elastomeric diaphragm.

15. Dispensing apparatus as claimed in claim 13 wherein the container is an ampule having a seal constituted by a duck bill valve.

* * * * *